US008950843B2

(12) United States Patent
Oikawa et al.

(10) Patent No.: US 8,950,843 B2
(45) Date of Patent: Feb. 10, 2015

(54) PRINTING APPARATUS AND PRINTING METHOD

(75) Inventors: Yuhei Oikawa, Yokohama (JP); Taku Yokozawa, Yokohama (JP); Kazuo Suzuki, Yokohama (JP); Satoshi Hayashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 302 days.

(21) Appl. No.: 12/787,634

(22) Filed: May 26, 2010

(65) Prior Publication Data

US 2010/0302301 A1 Dec. 2, 2010

(30) Foreign Application Priority Data

Jun. 2, 2009 (JP) ..... 2009-133309

(51) Int. Cl.
*B41J 29/38* (2006.01)

(52) U.S. Cl.
USPC ..... 347/17; 347/14; 347/19

(58) Field of Classification Search
USPC ..... 347/5, 9, 14, 17, 19
See application file for complete search history.

(56) References Cited

U.S. PATENT DOCUMENTS

| | | | | |
|---|---|---|---|---|
| 5,485,179 | A * | 1/1996 | Otsuka et al. | 347/14 |
| 7,413,279 | B2 * | 8/2008 | Arakawa et al. | 347/19 |
| 2009/0021548 | A1 | 1/2009 | Suzuki et al. | |
| 2010/0156977 | A1 | 6/2010 | Kanematsu et al. | |

FOREIGN PATENT DOCUMENTS

| | | | |
|---|---|---|---|
| JP | 2003-191467 | A | 7/2003 |
| JP | 2006-142806 | A | 6/2006 |
| JP | 2007-223144 | A | 9/2007 |

OTHER PUBLICATIONS

Notification of Reasons for Refusal dated Feb. 26, 2013, in Japanese Application No. 2009-133309.

* cited by examiner

*Primary Examiner* — Lam S Nguyen
(74) *Attorney, Agent, or Firm* — Fitzpatrick, Cella, Harper & Scinto

(57) ABSTRACT

There is an object of providing a printing apparatus which can restrict a variation in ejection characteristic of an ink droplet due to a temperature change of a printing head to restrict degradation in an image. The printing apparatus adjusts temperatures of the print head to first and second temperature so as to measure ejection characteristics of the print head at the first and second temperature. Then, a driving condition is generated based on the measured ejection characteristics and a printing is performed based on the measured ejection characteristics.

6 Claims, 8 Drawing Sheets

| HEAD TEMPERATURE | 30°C | 35°C | **40°C** | 45°C | 50°C | 55°C | **60°C** | 65°C | 70°C | 75°C |
|---|---|---|---|---|---|---|---|---|---|---|
| DRIVING CONDITION | No1 | No2 | No3 | No4 | No5 | No6 | No7 | No8 | No9 | No10 |

FIG.6

PRINTING APPARATUS AND PRINTING METHOD

BACKGROUND OF THE INVENTION

1. Field of the Invention

The present invention relates to an inkjet type printing apparatus and an inkjet type printing method.

2. Description of the Related Art

An inkjet type printing apparatus ejects fine ink droplets from many nozzles formed in a printing head toward a print medium and shifts the printing head in a width direction (main scanning direction) of the print medium to print an image on a given surface of the print medium. When in this inkjet type printing apparatus, an ejection velocity of the ink droplet ejected from each of the nozzles in the printing head shifting in the main scan direction varies, a deviation in an arrival spot of the ink droplet occurs. The deviation in the arrival spot of the ink droplet causes disturbance in a print image. Therefore, it is required to maintain the ejection velocity of the ink droplet ejected from the nozzle to be constant.

Generally when a variation in an environment temperature or a temperature of the printing head creates a variation in viscosity of ink, an ejection velocity of the ink droplet, an ink ejection amount and a particle diameter of the ink droplet vary. When a head temperature of the printing head increases during printing to lower the ink viscosity, the ejection velocity of the ink droplet increases. The image has a possibility of blurring or being rough due to the variation in the arrival spot of the ink.

In addition, a variation in individual dimension or temperature characteristics of components constituting a printing apparatus body and a substrate, a variation in dimension of the nozzle or an ink flow passage of the printing head, a variation in sheet resistance of a heater or the like is one of the causes generating a variation in ejection velocity of the ink droplet for each apparatus.

Further, when an ejection characteristic of ink changes with a use state of the printing apparatus, the ejection velocity of the ink droplet possibly changes.

For example, Japanese Patent Laid-Open No. 2006-142806 discloses a technology of controlling the ejection velocity of the ink droplet to be constant by velocity feedback or temperature feedback. According to this publication, an optimum driving condition for ejecting the ink droplet is selected from a relation between the ejection velocity of the ink droplet and the temperature of the printing head to restrict a variation in ejection velocity of the ink droplet due to a variation in temperature of the printing head.

Incidentally in the technology disclosed in the above publication, variations in dimension of the power source and the substrate of each printing apparatus body, in heater resistance of the printing head and so forth are not taken into account. Further, in some cases, a value of the temperature of the printing head to be detected is not necessarily equal to a temperature in the vicinity of the nozzle during printing and the ejection velocity varies. The ejection velocity of the ink droplet can not be possibly controlled appropriately depending on the kind of the ink or a difference in use method of the printing apparatus.

The present invention has an object of providing an inkjet type printing apparatus and an inkjet type printing method which can restrict a fluctuation in ejection velocity of an ink droplet due to a temperature change of a printing head or variations in dimension of components constituting a printing apparatus body or the like to restrict degradation of an image.

SUMMARY OF THE INVENTION

According to a first aspect of the present invention, an ink jet printing apparatus includes a printing unit configured to print an image on a print medium by moving a printing head relative to the print medium and driving the printing head based on a given driving condition so as to eject ink droplets, a temperature adjusting unit configured to adjust a temperature of the print head to a target temperature, a characteristic measuring unit configured to measure an ejection characteristic of the ink droplet ejected from the printing head, and a driving condition generating unit configured to generate a driving condition for the print head based on the ejection characteristic of the print head measured by the characteristic measuring unit at first temperature and second temperature different therefrom when adjusting temperature of the print head to the first and second temperature.

According to a second aspect of the present invention, an ink jet printing method includes a step of printing an image on a print medium by moving a printing head relative to the print medium and driving the printing head based on a given driving condition so as to eject ink droplets, a step of adjusting temperature of the print head to a target temperature, and a step of generating a driving condition for the printing head based on the ejection characteristic of the printing head measured by the characteristic measuring unit at first temperature and second temperature different therefrom when adjusting the temperature of the print head to the first and second temperature.

Further features of the present invention will become apparent from the following description of exemplary embodiments (with reference to the attached drawings).

BRIEF DESCRIPTION OF THE DRAWINGS

FIG. 6 is a diagram showing the correlation table between the temperature and the driving condition of the printing head in the printing apparatus in FIG. 1;

DESCRIPTION OF THE EMBODIMENTS

Hereinafter, embodiments of the present invention will be in detail explained with reference to the drawings.

First Embodiment

Figure 1:
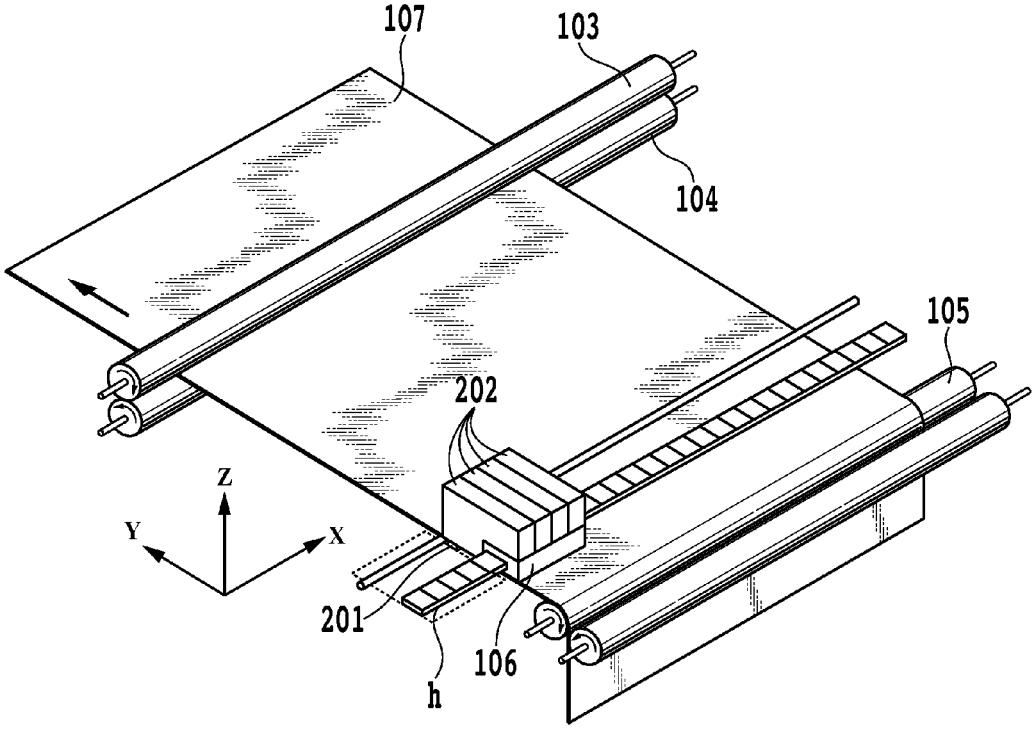
FIG. 1 is a schematic perspective view showing the arrangement of a printing apparatus according to a first embodiment of the present invention.

FIG. 1 is a perspective view showing a schematic arrangement of an inkjet type printing apparatus of the present embodiment. The printing apparatus comprises a carriage 106, a printing head 201 detachably mounted in the carriage 106 and ink cartridges 202 detachably mounted in the carriage 106 for supplying ink to the printing head 201. The ink cartridges 202 accommodate each color ink of four colors (black, cyan, magenta and yellow). A sheet feeding roller 103 rotates in an arrow direction in the figure while nipping a print medium 107 together with an auxiliary roller 104, carrying the print medium 107 such as a print sheet. The carriage 106 supporting the four ink cartridges shifts the ink cartridge 202 and the printing head 201 in a width direction (±X direction) of the print medium for scanning. The carriage 106 is positioned in a home position shown in a broken line of the figure when the printing apparatus does not perform a print operation or a recovery operation of the printing head is performed. The printing head 201 is provided with a temperature detecting sensor (not shown) for detecting a temperature of the printing head.

Upon receiving a print start command, the carriage 106 positioned in the home position is shifted in the X direction of the figure (main scanning direction) and a print element provided in the printing head 201 is driven to print an image on the print medium. When the print is completed to an end of the print medium 107, the carriage 106 is returned back to the original home position and again shifts in the +X direction for printing. For a period between a point where the previous main scan is completed and a point where the subsequent main scan begins, the sheet feeding roller 103 rotates in an arrow direction shown in the figure and the print medium 107 is carried in a +Y direction (sub scan direction) by a necessary width. By repeating this main scanning and the sheet feeding, the printing of an image on the print medium is completed. An operation of ejecting ink from the printing head is controlled by a print control unit (not shown).

It should be noted that the printing apparatus according to the present embodiment prints an image only at the scanning in the +X direction as a forward route among the ±X direction, but the printing apparatus according to the present invention may be configured in such a manner as to perform a print operation also in the −X direction as a backward route for increasing a print velocity.

Further, in the printing apparatus of the present embodiment, the ink cartridge 202 and the printing head 201 are retained by the carriage 106 so as to be separable therefrom, but the present invention is not limited thereto. There may be used an inkjet cartridge integral with the ink cartridge 202 for accommodating ink for printing and the printing head 201 or a plural-color one-piece printing head capable of ejecting ink of plural colors from the single printing head.

In addition, the printing apparatus of the present embodiment is provided at a position for performing a recovery operation with a capping device for capping an ejection opening surface and a recovery unit (not shown) for performing a head recovery operation such as an operation of removing viscosity improving ink or air bubbles in the printing head in a state of capping the ejection opening surface with the capping device. The capping device is at one side with a cleaning blade supported in such a manner as to be extendable toward the printing head 201 and the cleaning blade is capable of abutting against the ink ejection surface of the printing head. Thereby, the cleaning blade projects into a shift route of the printing head after the recovery operation and unnecessary ink droplets and fouling existing on the ejection opening surface are wiped off by the shifting of the printing head.

Figure 2:
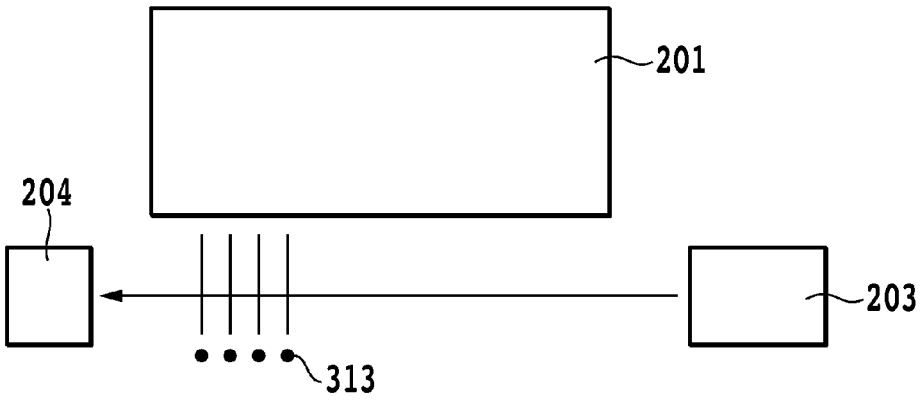
FIG. 2 is a schematic arrangement diagram of a velocity detecting device in the printing apparatus in FIG. 1.

FIG. 2 is a diagram showing a schematic arrangement of a velocity detecting device for detecting a velocity of the ink droplet ejected from the printing head. It should be noted that the velocity detecting device constitutes characteristic measuring unit for measuring an ejection characteristic of the ink droplet ejected from the printing head.

This velocity detecting device is disposed at a lower portion of the carriage 106 in the printing apparatus of the present embodiment. The velocity detecting device comprises a light emitting element 203 composed of a LED, a laser or the like and a photo acceptance unit 204 composed of a photo diode or the like.

In the ejection velocity detecting device of the present embodiment, the light emitting element 203 emits a detection light L for detecting passing of ink droplets 313 ejected from each nozzle of the printing head 201. The photo acceptance unit 204 receives the detection light L emitted from the light emitting element 203. The detection light L is perpendicular to a main scan direction of the printing head 201 and is in parallel with each nozzle arrangement direction of the printing head 201, and is emitted such that a height position of the detection light L along an ejection direction of the ink droplet 313 is lower than a position of a nozzle face of the printing head 201. With such an arrangement, when any nozzle line of the printing head 201 is positioned on the detection light L, a passing route of the ink droplet 313 ejected from the nozzle intersects with the detection light L. Based upon the above, an ejection velocity of the ink droplet 313 is detected by the ejection velocity detecting device.

Figure 3:
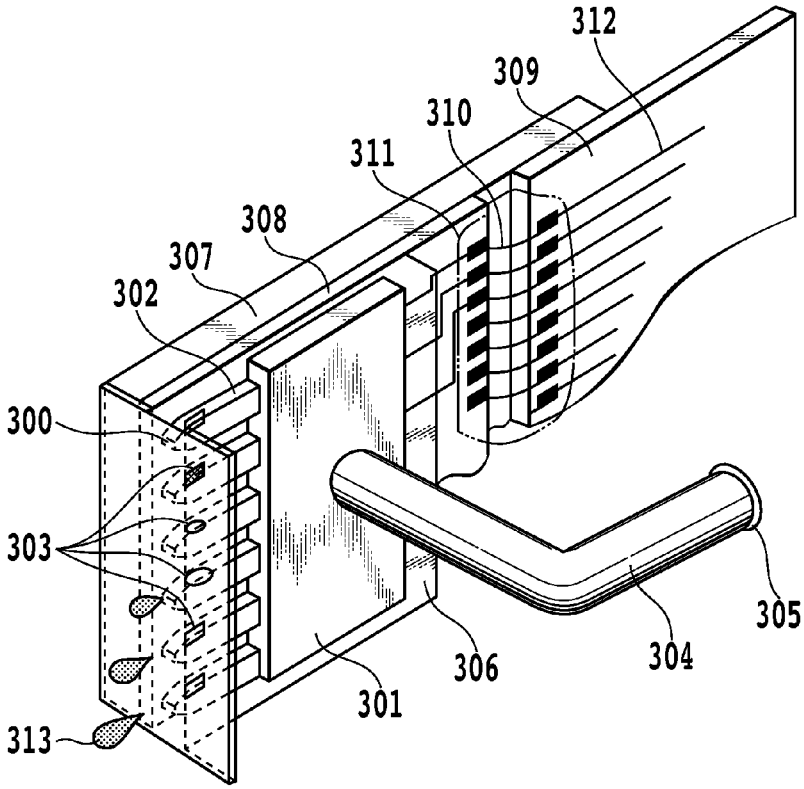
FIG. 3 is a partial perspective view showing the arrangement of a printing head in the printing apparatus in FIG. 1.

FIG. 3 is a partial perspective view showing an arrangement of the printing head in the present embodiment. The printing head 201 is provided with a plurality of ejection openings 300 respectively arranged by predetermined pitches. A print element 303 for generating energy for ink ejection is arranged along a wall surface of each liquid passage 302 making communication between a common liquid chamber 301 and each ejection opening 300. The print element 303 and the circuit are formed on a silicon wafer by using a semiconductor manufacturing technology. A temperature sensor (not shown) and a sub heater (not shown) are also formed all together therewith on the same silicon wafer by the process similar to the semiconductor manufacturing process. A silicon plate 308 on which the electrical wiring is formed is connected to an aluminum-based plate 307 for heat release. A circuit connection unit 311 and a print plate 309 on the silicon wafer are connected by an extra thin wire 310 and a signal from the print apparatus body is received through a signal circuit 312. The liquid passage 302 and the common liquid chamber 301 are formed with a plastic cover 306 formed by injection molding. The common liquid chamber 301 is connected through a joint pipe 304 and an ink filter 305 to an ink tank of the ink cartridge 202. Ink is supplied from the ink tank to the common liquid chamber 301. The ink which is supplied from the ink tank to the common liquid chamber 301 and temporarily stored in the common liquid chamber 301 enters into the liquid passage 302 by a capillary phenomenon and forms meniscus in the ejection opening 300 to maintain the liquid passage 302 to be filled with the ink. At this time, when the print element 303 is energized through electrodes to generate heat, the ink on the print element 303 is rapidly heated to generate air bubbles in the liquid passage 302 and the ink droplet 313 is ejected from the ejection opening 300 by expansion of the air bubbles.

Figure 4:
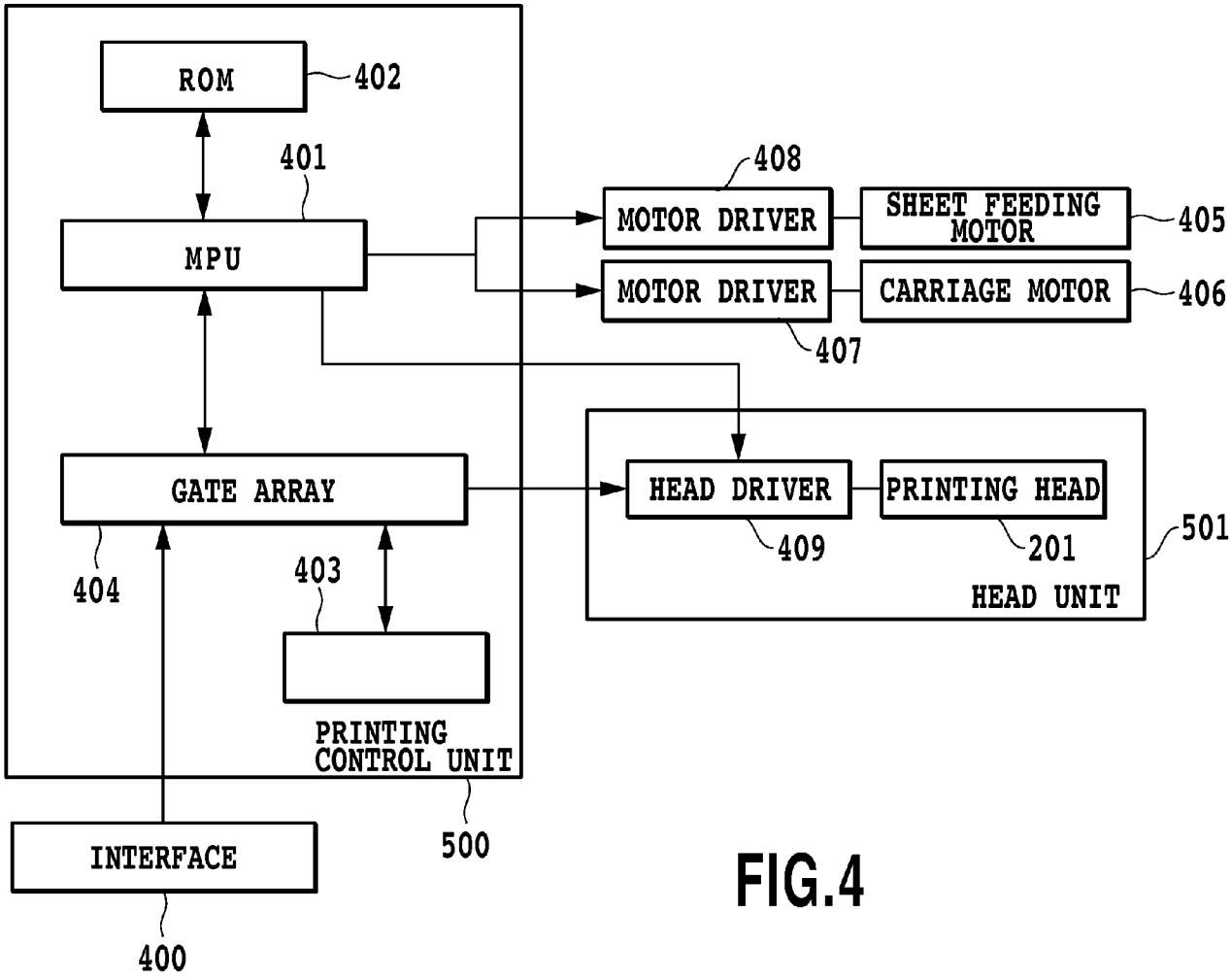
FIG. 4 is a block diagram showing a control system in the printing apparatus in FIG. 1.

FIG. 4 is a block diagram showing an arrangement of a control system in the printing apparatus arrangement of the present embodiment. An interface 400 inputs print signals and the like, and a program ROM 402 stores control programs executed by a MPU 401. A dynamic type RAM (DRAM) 403 can store various data such as print data supplied to the print signal and the printing head, and can store print dot numbers, the number of times of replacement of the ink printing head and the like. A gate array 404 performs supply control of print data to the printing head and performs transfer control of data between the interface 400, the MPU 401 and the DRAM 403. A carriage motor (CR motor) 406 is a motor for carrying the printing head, and a sheet feeding motor (LF motor) 405 is a motor for carrying print sheets. Motor drivers 407 and 408 are motors for driving the carriage motor 406 and the sheet feeding motor 405 respectively. A head driver 409 drives the printing head 201.

Next, an explanation will be made in regard to correction control of an ink droplet ejection amount in the present embodiment. In the present embodiment, from an ejection velocity of each ink at two different temperatures (first and second temperatures) and a driving condition in which the ejection velocity becomes the nearest to a target ejection velocity, a correlation table between the head temperature and the driving condition is calculated such that the ejection velocity becomes a constant target ejection velocity. Based upon the correlation table, the ink droplet ejection amount ejected from the ejection opening of the printing head is controlled to reduce degradation in an image quality.

Figure 5:
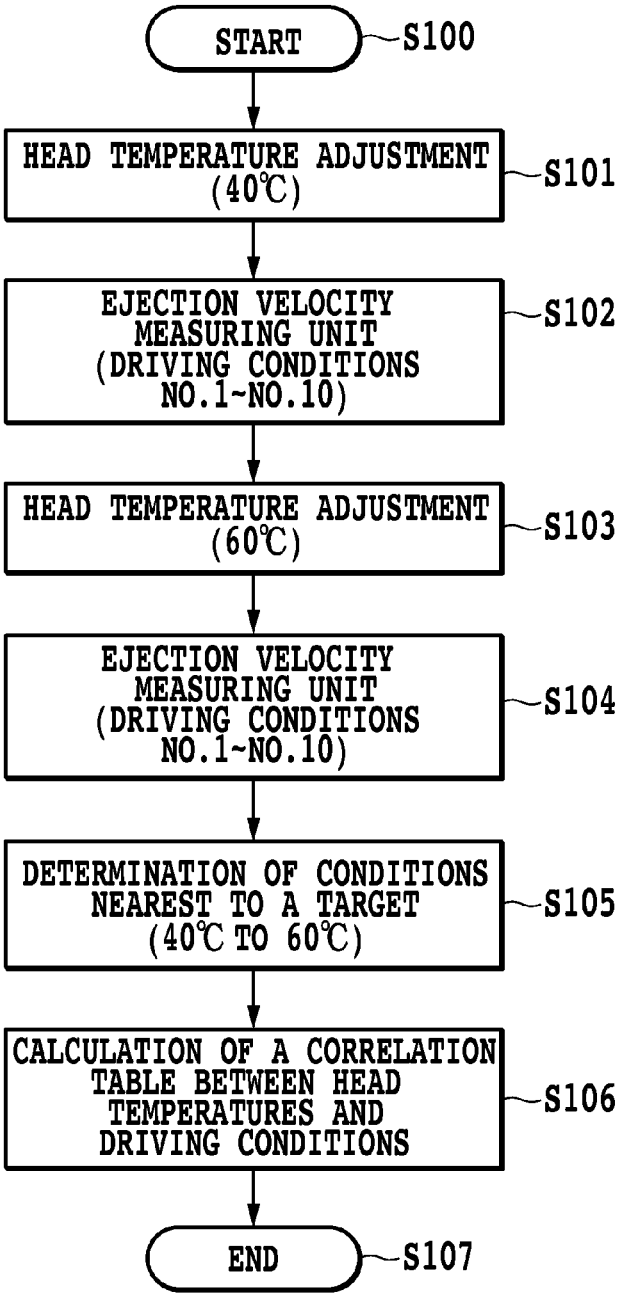
FIG. 5 is a flow chart showing the process of calculating a correlation table between a temperature and a driving condition of the printing head in the printing apparatus in FIG. 1.

FIG. 5 is a flow chart showing the process of calculating the correlation table between the head temperature and the driving condition in the present embodiment.

When the ink droplet ejection amount control starts (S100), the head temperature of the printing head is adjusted to 40° C. by a temperature adjusting unit (S101). The ejection characteristic of the ink droplet is measured by a measuring unit (S102). That is, a driving condition of a drive signal applied to the printing head for ejecting ink droplets from the ejection opening is changed and the drive signal is applied to the printing head by a driving unit to measure an ejection velocity of the ink droplet. In the present embodiment, the ejection velocity is measured based upon 10 kinds of the driving conditions (from No. 1 to No. 10 of the driving conditions). The measurement result of the ejection velocity is stored on a memory in the printing apparatus.

Herein, the driving condition of the present embodiment includes changing a voltage of the drive signal applied to the printing head, changing a pulse width of the drive signal applied to the printing head, changing an inclination at the rising of the drive signal applied to the printing head and the like. However, the present invention is not limited to these driving conditions and the kind of the driving condition is not particularly limited so long as it can change the ejection velocity of the ink droplet.

Next, the head temperature of the printing head is adjusted to 60° C. by the temperature adjusting unit (S103). The ejection velocity is measured while changing the driving condition (No. 1 to No. 10 of the driving conditions) for ejecting the ink droplet from the ejection opening (S104). The measurement result of the ejection velocity is stored on the memory in the printing apparatus.

Next, an ejection condition in which the result of each ejection velocity at the head temperature of 40° C. and the head temperature of 60° C. of the printing head measured at step S102 and at step S104 is the nearest to a predetermined ideal ejection velocity is determined as an ejection condition of each temperature (S105).

Based upon the driving conditions at the head temperature of 40° C. and the head temperature of 60° C., a correlation table between the head temperature and the driving condition of the printing head is calculated by a driving condition calculating unit (S106). The correlation table thus calculated is reflected to the driving condition while acquiring the head temperature of the printing head during printing.

It should be noted that in the present embodiment, the ejection velocity at each of two temperatures of 40° C. and 60° C. is measured, but the present invention is not limited to such a measurement. That is, an ejection velocity at each of three or more head temperatures may be measured by differentiating driving conditions and the head temperature to be measured is not limited to 40° C. and 60° C., either.

FIG. 6 is a diagram showing a correlation table between the head temperature and the driving condition in the present embodiment. The correlation table between the head temperature and the driving condition based upon the driving conditions at the head temperature of 40° C. and the head temperature of 60° C. is calculated with linear interpolation of the driving conditions between the two points. It should be noted that in a case of determining the driving conditions at head temperatures of three or more temperatures, interpolation using an approximate expression may be performed. The correlation table between the head temperature and the driving condition of the printing head may be calculated as a correlation relational expression of the head temperature and the driving condition.

Next, a printing method of the present embodiment will be explained.

Figure 7A:
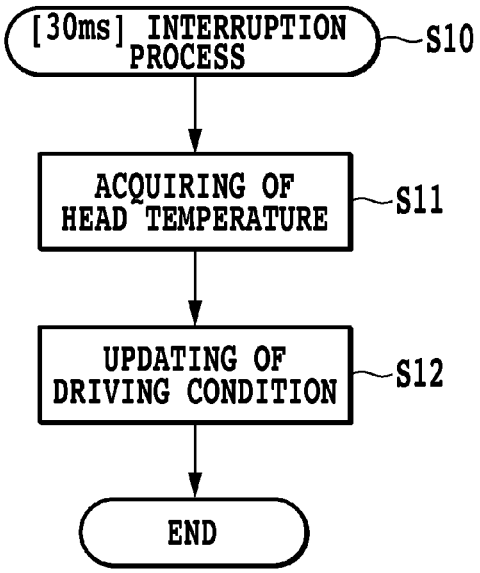
FIG. 7A is a flow chart showing the process of a printing method by the printing apparatus in FIG. 1.
Figure 7B:
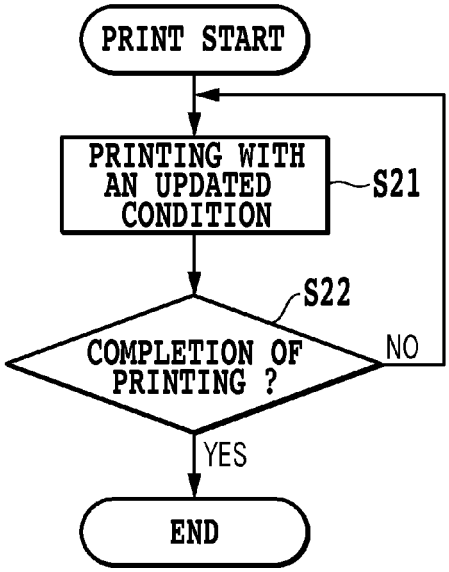
FIG. 7B is a flow chart showing the other process of the printing method by the printing apparatus in FIG. 1.

FIG. 7 is a flow chart showing the process of a printing method in the present embodiment. First, a temperature of the printing head is acquired as an interruption process (S10) at 30 ms (S11). In addition, the driving condition is updated (S12). In the present embodiment, the interruption process is executed by a time interval of 30 ms, but in the present invention, an optimum time interval may be used in accordance with the system.

On the other hand, at printing, the driving condition in the scan is changed as needed based upon the driving condition updated by the interruption process to perform the printing by a print control unit (S21). When it is determined that the printing is completed (S22), the printing process ends.

In the present embodiment, for finding a driving condition for making an ejection velocity of the ink droplet of the printing head measured under each of plural driving conditions by the velocity detecting unit at each of a first temperature and a second temperature different from the first temperature of the printing head a target ejection velocity of the ink droplet ejection velocity of the printing head in accordance with the temperature of the printing head, a correlation table for correlating the temperature with the driving condition is calculated. That is, the driving condition is calculated from the ejection velocity measured at each of the different temperatures of the printing head. Hereby, a variation in image density or degradation in image quality based upon the ejection velocity variation due to a temperature change of the printing head can be reduced.

It should be noted that in the present embodiment, the relation between the head temperature and the driving condition is found by measuring the ejection velocity of the ink droplet as the measurement unit for measuring the ejection characteristic of the ink droplet. However, the ejection characteristic of the present invention is not limited to the ejection velocity of the ink droplet. That is, there is herein required only the characteristic which can restrict degradation of an image quality by variations in the ejection characteristic of the ink droplet due to the temperature change of the printing head. For example, the ejection variation may be found by measuring an ejection amount of the ink droplet or a particle diameter of the ink droplet to calculate a relation between the head temperature and the driving condition. In this case, a measuring device such as a camera for measuring the ejection amount of the ink droplet or the particle diameter of the ink droplet is required.

Second Embodiment

In the aforementioned embodiment, the correlation table of the driving condition to the head temperature is calculated by measuring plural ejection velocities under plural different driving conditions at each of the two different temperatures of the printing head. However, the present invention is not limited thereto. From a driving condition in which ejection velocities in a reference driving condition at a reference temperature and in a comparison driving condition at a comparison temperature are constant, the correlation table of the driving condition to the head temperature may be calculated. That is, based upon the aforementioned embodiment, there may be used a method of easily reducing image density variations or degradation in image quality due to the ejection velocity fluctuation by the temperature change of the printing head. In consequence, this method can acquire the effect of the present invention and also can control the ink droplet ejection amount ejected from the ejection opening of the printing head to reduce degradation in the image quality.

Figure 8:
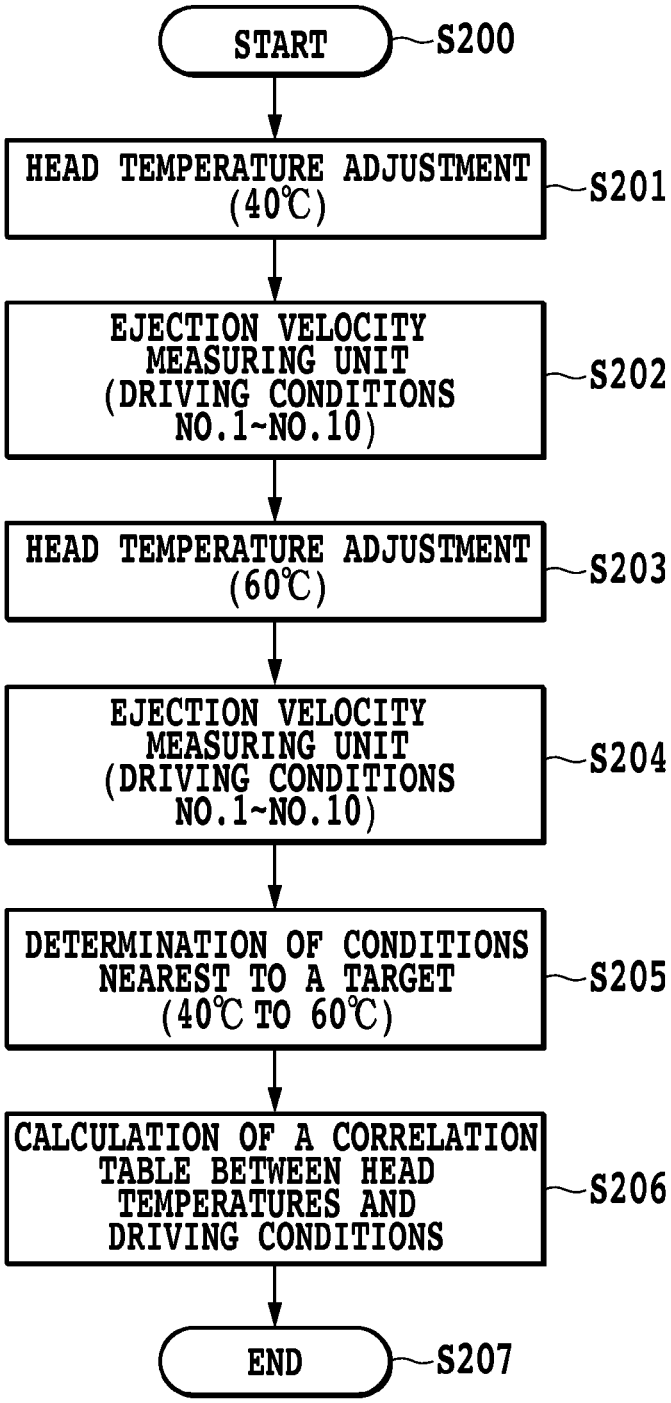
FIG. 8 is a flow chart showing the process of calculating a correlation table between a head temperature and a driving condition according to a second embodiment of the present invention.

FIG. 8 is a flow chart showing the process of calculating the correlation table between the head temperature and the driving condition in the present embodiment.

When the ink droplet ejection amount control starts (S200), the head temperature of the printing head is adjusted to 40° C. as a reference temperature in the present embodiment (S201). Further, the driving condition for ejecting the ink droplet from the ejection opening is made to a reference driving condition to measure the ejection velocity (S202). In the present embodiment, the reference driving condition No. 3 is used as a driving condition as a reference. The result of measuring the ejection velocity is stored on the memory of the printing device.

Next, the head temperature of the printing head is adjusted to 60° C. by the temperature adjusting unit (S203). The ejection characteristic of the ink droplet is measured by the measuring unit (S204). That is, the driving condition of the drive signal applied to the printing head for ejecting the ink droplet from the ejection opening is changed and the drive signal is applied to the printing head by the drive unit to measure the ejection velocity. Here, the ejection velocity is measured while changing the driving condition (No. 1 to No. 10 of the driving conditions) for ejecting the ink droplet from the ejection opening. The measurement result of the ejection velocity is stored on a memory in the printing apparatus.

Next, an ejection condition in which the result of each ejection velocity at the head temperature of 40° C. and the head temperature of 60° C. of the printing head measured at step S202 and at step S204 is the nearest to a predetermined ideal ejection velocity is determined as an ejection condition of each temperature (S205).

Based upon the driving conditions at the head temperature of 40° C. and the head temperature of 60° C., a correlation table between the head temperature and the driving condition of the printing head is calculated by a driving condition calculating unit (S206). The correlation table thus calculated is reflected to the driving condition while acquiring the head temperature during printing.

It should be noted that in the present embodiment, the ejection velocity at each of the two temperatures of 40° C. and 60° C. is measured, but the present invention is not limited to such a measurement. That is, an ejection velocity at each of three or more head temperatures may be measured by differentiating the driving condition or the head temperature to be measured is not limited to 40° C. and 60° C., either. In addition, the correlation table between the head temperature and the driving condition based upon the driving conditions at the head temperature of 40° C. and the head temperature of 60° C. is calculated with linear interpolation of the driving conditions between the two points. It should be noted that in a case of determining the driving condition at head temperatures of three or more temperatures, interpolation using an approximate expression may be performed. The correlation table between the head temperature and the driving condition of the printing head may be calculated as a correlation relational expression of the head temperature and the driving condition.

In the present embodiment, from a driving condition in which ejection velocities in a reference driving condition at a reference temperature and in a comparison driving condition at a comparison temperature are constant, the correlation table of the driving condition to the head temperature is calculated for each body. Thereby, it is possible to reduce image density variations or degradation in image quality due to the ejection velocity variation by the temperature change of the printing head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-133309, filed Jun. 2, 2009, which is hereby incorporated by reference herein in its entirety.

What is claimed is:

1. An ink jet printing apparatus comprising:

a printing head having nozzles configured to eject ink droplets;

an acquiring unit configured to acquire a temperature of the printing head;

a measuring unit configured to measure ejection characteristics of ink droplets ejected from the printing head;

a determination unit configured to determine driving conditions of the printing head at a plurality of temperatures of the printing head including at least two temperatures of the printing head and temperatures different from the at least two temperatures of the printing head based on the ejection characteristics of ink droplets measured by the measuring unit at the at least two temperatures of the printing head, such that the ejection characteristics at the plurality of temperatures of the printing head approach a target ejection characteristic; and a driving unit configured to drive the printing head according to the driving condition determined based on the driving conditions at the plurality of temperatures of the printing head determined by the determination unit and the head temperature of the printing head acquired by the acquiring unit, wherein the determination unit determines the driving conditions at the plurality of temperatures of the printing head by interpolation based on the ejection characteristics of the ink droplets measured by the measuring unit at the at least two temperatures of the printing head.

2. The ink jet printing apparatus according to claim 1, wherein each ejection characteristic is any of an ejection velocity of the ink droplet, an ejection number of the ink droplet and a particle diameter of the ink droplet.

3. The ink jet printing apparatus according to claim 1, wherein the interpolation is linear interpolation or interpolation using an approximate expression.

4. An ink jet printing apparatus including a printing head having nozzles configured to eject ink droplets, the ink jet printing apparatus comprising:

an acquiring unit configured to acquire a head temperature of the printing head;

a detection unit configured to detect passing of ink droplets ejected from the printing head;

a determination unit configured to determine driving conditions of the printing head at a plurality of temperatures of the printing head including at least two temperatures of the printing head and temperatures different from the at least two temperatures of the printing head based on timings of passing of ink droplets detected by the detection unit at the at least two temperatures of the printing head, such that the timings of passing of ink droplets at the plurality of temperatures of the printing head approach a target timing of passing of ink droplets; and a driving unit configured to drive the printing head at the driving condition determined based on the driving conditions at the plurality of temperatures of the printing head determined by the determination unit and the temperature of the printing head acquired by the acquiring unit, wherein the determination unit determines the driving conditions at the plurality of temperatures of the printing head by interpolation based on the timings of passing detected by the detection unit at the at least two temperatures of the printing head.

5. The ink jet printing apparatus according to claim 4, wherein the detection unit comprises a photo detection unit including a light emitting element and a light receiving unit.

6. The ink jet printing apparatus according to claim 4, wherein the interpolation is linear interpolation or interpolation using an approximate expression.

* * * * *